US008365653B2

(12) United States Patent
Flegel

(10) Patent No.: US 8,365,653 B2
(45) Date of Patent: Feb. 5, 2013

(54) HYDRAULIC PUMP

(75) Inventor: Michael W. Flegel, Elgin, IL (US)

(73) Assignee: Ultimate Pump, Inc., Elgin, IL (US)

( * ) Notice: Subject to any disclaimer, the term of this patent is extended or adjusted under 35 U.S.C. 154(b) by 829 days.

(21) Appl. No.: 12/506,967

(22) Filed: Jul. 21, 2009

(65) Prior Publication Data

US 2011/0017060 A1 Jan. 27, 2011

(51) Int. Cl.
*F01B 3/00* (2006.01)

(52) U.S. Cl. ..... 92/12.2; 92/57

(58) Field of Classification Search ..... 92/12, 57, 92/12.2, 71, 56, 54; 417/269; 91/499, 502, 91/503

See application file for complete search history.

(56) References Cited

U.S. PATENT DOCUMENTS 2,074,450 A * 3/1937 Alley ..... 91/503
4,756,239 A * 7/1988 Hattori et al. ..... 92/71
5,209,190 A 5/1993 Paul
5,342,178 A * 8/1994 Kimura et al. ..... 417/269
5,638,736 A * 6/1997 Murakami et al. ..... 92/71
6,145,429 A 11/2000 Paul
6,837,691 B2 * 1/2005 Tarutani et al. ..... 417/269
7,997,880 B2 * 8/2011 Lim et al. ..... 417/269
2008/0105222 A1 5/2008 Kubes et al.
2010/0178178 A1 * 7/2010 Sato et al. ..... 417/269

OTHER PUBLICATIONS

Kennedy, Bill, "Pumping innovation," Cutting Tool Engineering, Apr. 2009, p. 20-21, vol. 61, issue 4.

* cited by examiner

*Primary Examiner* — Thomas E Lazo
*Assistant Examiner* — Logan Kraft
(74) *Attorney, Agent, or Firm* — Momkus McCluskey, LLC; Jefferson Perkins; Karen Blouin

(57) ABSTRACT

A pump has an axial drive shaft with a cam fence that extends radially outwardly from an axis of the drive shaft. The cam fence axially displaces, in respective cylinders, each of a plurality of elongate pistons arranged in parallel to and around the axis and angularly spaced apart from each other. The axial position of an outer margin of the cam fence varies as a function of its radial angle with the axis. In one part of the operation of the pump, a piston is withdrawn to uncover a radial inlet port to draw fluid into the cylinder from an internal reservoir volume formed in the drive shaft. In a second part of the operation, the drive shaft is further rotated to open a cylinder end port by means of a rotary valve and closing the side port of the cylinder with a portion of the drive shaft body. In a third part of the operation, the piston is advanced to push fluid out of the cylinder end port into an output chamber. The pump is double-ended such that opposed ends of any piston are drawing in fluid, and pushing out fluid, at the same time.

8 Claims, 9 Drawing Sheets

HYDRAULIC PUMP

BACKGROUND OF THE INVENTION

Conventional pumps have many parts and usually include o-rings or other seals. This sharply drives up their cost of manufacture. Improvements could therefore be made in providing a pump that is simpler in design and less costly than conventional offerings.

An internal combustion engine has been proposed by which a set of pistons and cylinders, disposed in parallel to a central axis but radially displaced therefrom, provide power to a central shaft by means of a cam drive. See United States Patent Application Publication No. US 2008/0105222 A1 to Kubes et al. But this arrangement heretofore has not been applied to situations in which a central drive shaft supplies rotational power instead of receiving it, and in which the pumping of a fluid is the desired work.

SUMMARY OF THE INVENTION

According to one aspect of the invention, a hydraulic pump includes an axial drive shaft with a radially extending cam fence. The axial position of an outer margin of the cam fence varies as a function of its angular position relative to the axis. At least one piston is disposed in parallel to, and spaced from, the axis. A cutout in the side surface of the piston receives the outer margin of the cam fence. As the drive shaft is rotated, the piston is displaced in an axial direction to be withdrawn from or advanced into a cylinder.

The cylinder has a side port that periodically communicates with an inlet reservoir volume disposed radially inwardly from it and which rotates with the drive shaft, and an end port that periodically communicates with an outlet chamber. A cylindrical surface of the drive shaft periodically opens and closes the side port. A rotary valve, which rotates with the drive shaft, periodically closes and opens the end port. One or more fluid inlets communicate with the inlet reservoir while one or more fluid outlets communicate with the outlet chamber.

In operation, rotation of the drive shaft will cause the side port closing surface thereof to be rotated beyond the cylinder side port, putting the interior of the piston cylinder in communication with the fluid inlet reservoir. After the side port opens, the cam fence causes the piston to be withdrawn, drawing fluid into the piston cylinder. Further rotation of the drive shaft causes the closing surface of the drive shaft to again close the side port. Then, the rotary valve begins opening the end port. When the end port is opened the piston will begin advancing down the cylinder to expel fluid into the outlet chamber. The cycle then repeats.

It is preferred that the piston be double-ended and that the pump structure essentially be mirrored around a center line drawn orthogonally to the axis, with a second inlet reservoir volume, drive shaft cylindrical side port closing surface, rotary valve and end chamber being provided. It is preferred that the first and second inlet reservoir volumes be in communication with each other and that they form portions of a unitary fluid reservoir that surrounds the drive shaft between the end or output chambers. As one end of the piston is being advanced further into one cylinder, expelling fluid into the output chamber, the opposed end of the piston is being retracted within another cylinder to draw in fluid from the inlet reservoir.

It is also preferred that there be more than one piston disposed in parallel to the drive shaft axis, so as to be angularly spaced from the first piston relative to the axis. In one embodiment the pistons are provided in one or more opposed pairs, each piston pair being separated by 180 degrees. In the illustrated embodiment four such piston pairs have been provided, equally spaced from each other. More than eight pistons could be provided in some embodiments. In other embodiments the number of pistons can be odd, such as three, five, seven or more. It is preferred that the pistons be distributed around the axis at a constant radius from therefrom and at an equal angular separation from each other.

The pump according to the invention has several technical advantages. Relative to conventional pump structures, it is easy to manufacture as it has a total of nineteen parts in the illustrated embodiment, of only seven different types: one drive shaft, eight pistons, two cylinder block inserts, two cylinder block casings, two rotary valves, two support bearings and two end caps. There are no seals or O-rings. The pump may be easily scaled to different volumes and pressures and can be made from a variety of materials depending on its intended application. The pump is suitable for pumping any fluid, including water, which has at least a minimal viscosity.

BRIEF DESCRIPTION OF THE DRAWINGS

Further aspects of the invention and their advantages can be discerned in the following detailed description, in which like characters denote like parts and in which.

DETAILED DESCRIPTION

Figure 1:
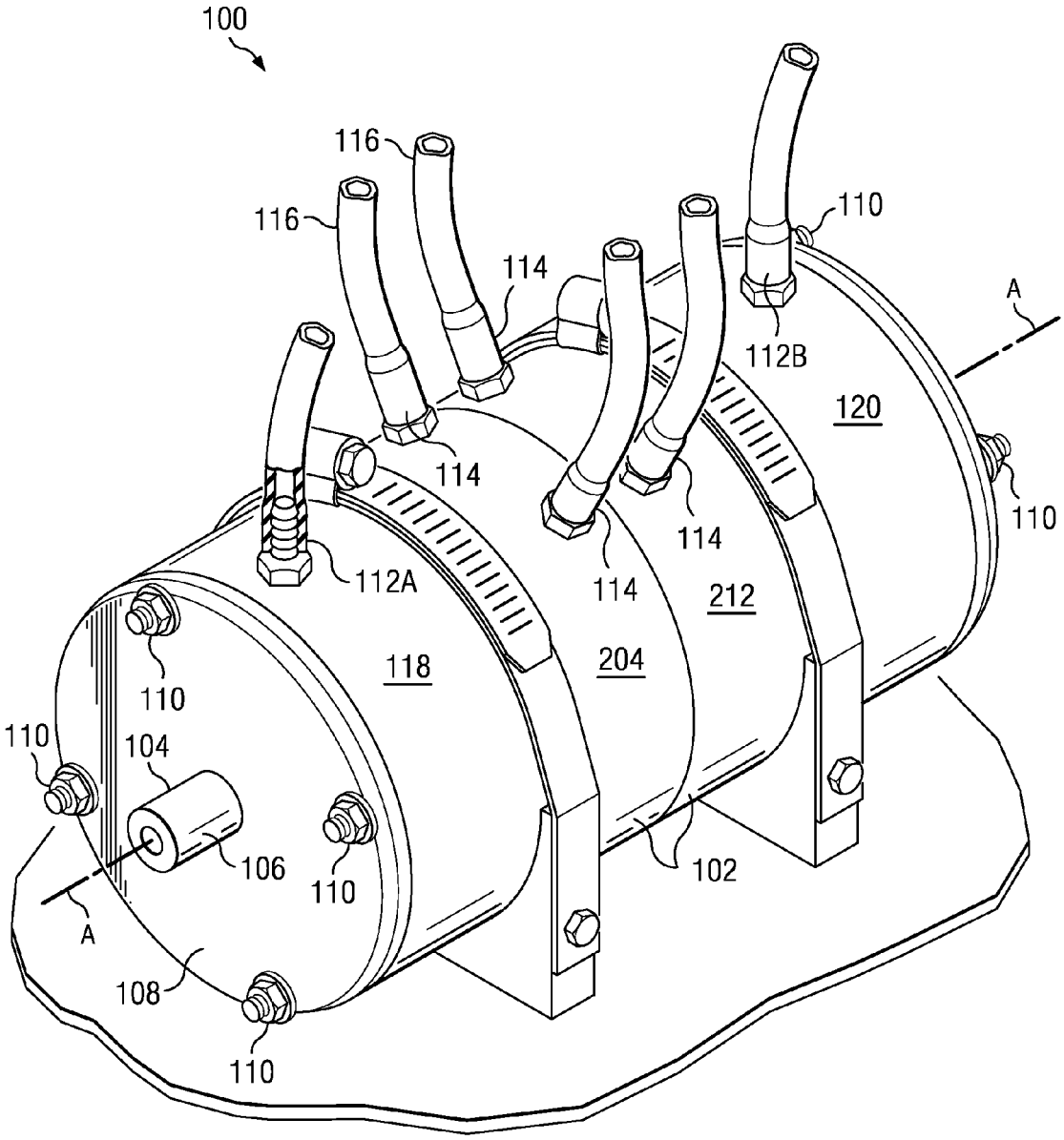
FIG. 1 is an isometric view of a hydraulic pump according to the invention.

Referring first to FIG. 1, an isometric view is shown of a pump indicated generally at 100 according to a first embodiment of the invention. The pump 100 has an external cylindrical casing 102 which is formed around an axis A. One end 104 of a drive shaft 106 extends beyond an end cap 108, which in this embodiment is bolted to the casing 102 with throughbolts 110 which extend the entire axial length of the pump 100 and are parallel to axis A. Four bolts 110 are shown in the illustrated embodiment; for embodiments meant for higher-pressure applications, the number of bolts 110 could be increased. The drive shaft 106 is generally aligned with axis A although is not radially symmetrical throughout, as will be described below.

The pump 100 has at least one, and preferably two, outlet ports 112A and 112B through which a fluid is pumped. In the illustrated embodiment, the pump 100 further has several inlet ports 114 and these preferably are capable of introducing a greater volume of fluid into the interior of casing 102 than can exit casing 102 through exits 112A and 112B. This ensures that the internal inlet reservoir and end exit chambers of the pump (both to be described below) will always be full of fluid. The illustrated embodiment is adapted for situations in which pump 100 is not immersed in the fluid to be pumped but rather is fed fluid through tubes or conduits 116. In an alternative embodiment in which pump 100 is designed to be immersed in the fluid to be pumped, the inlet ports 114 are replaced with a more open framework (not shown) in the middle of the casing 102 such that the surrounding fluid in which the pump 100 is immersed can make its way into the pump interior.

While in one embodiment the pump can be single-ended, for greatest operational efficiency and cost effectiveness it is preferred that pump 100 be double-ended, with a first axial end 118 having a first outlet port 112A and a second, opposed axial end 120 having a second outlet port 112B. Each end 118, 120 further has a set of inlet ports 114. As will be described below, each of the reciprocating pistons within the housing 102 will alternately pump fluid out of outlet 112A and out of outlet 112B.

The pump 100 derives its power through the rotation, in a predetermined direction, of drive shaft 106 around axis A. Shaft 106 may be coupled to any conventional source of torque, including a motor, an internal combustion engine (which may be of a vehicle or could be a stand-alone engine), a turbine, a cog and drive chain, a belt or even a hand crank.

Figure 2:
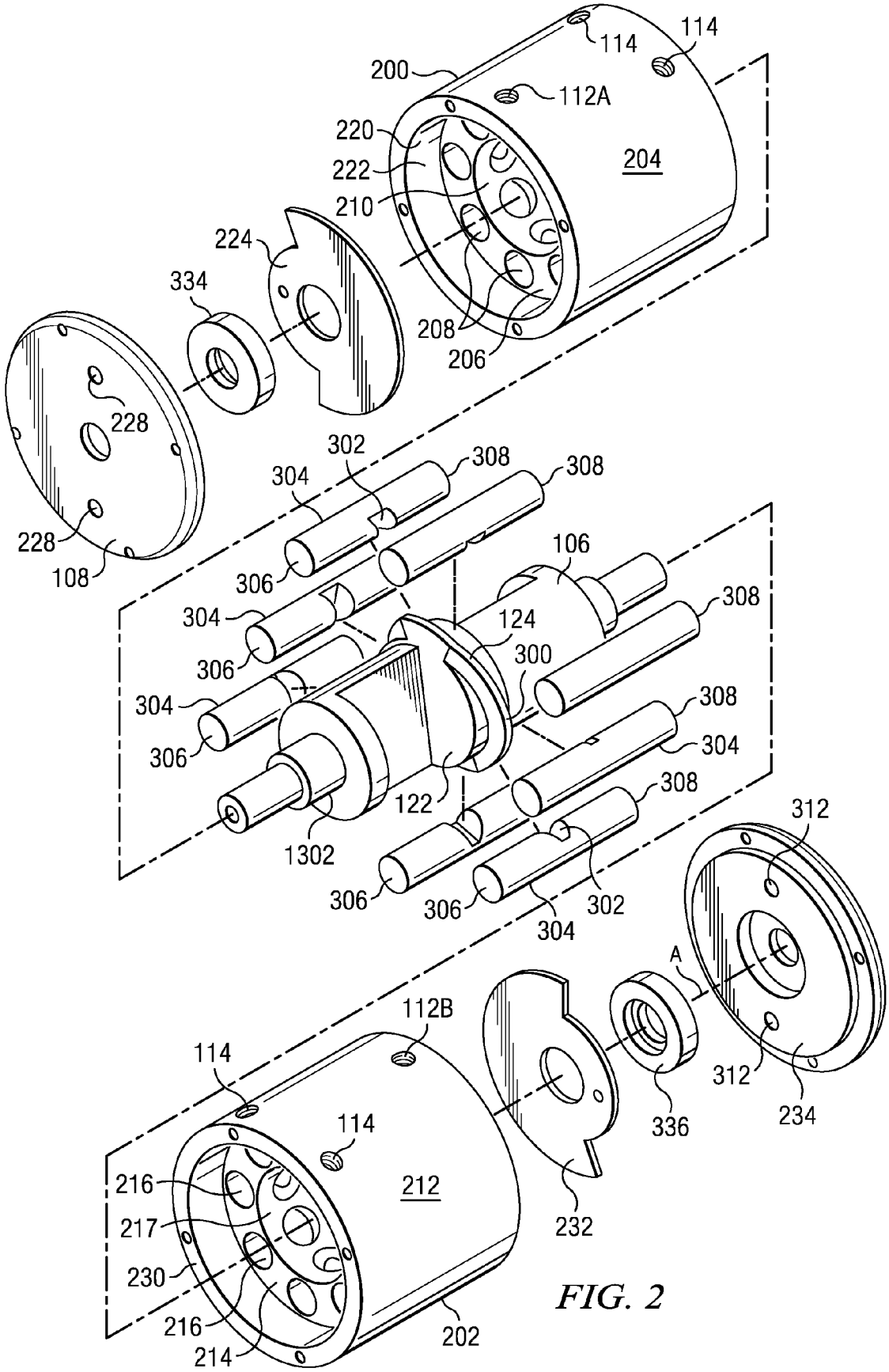
FIG. 2 is an exploded isometric view of the pump illustrated in FIG. 1.
Figure 3:
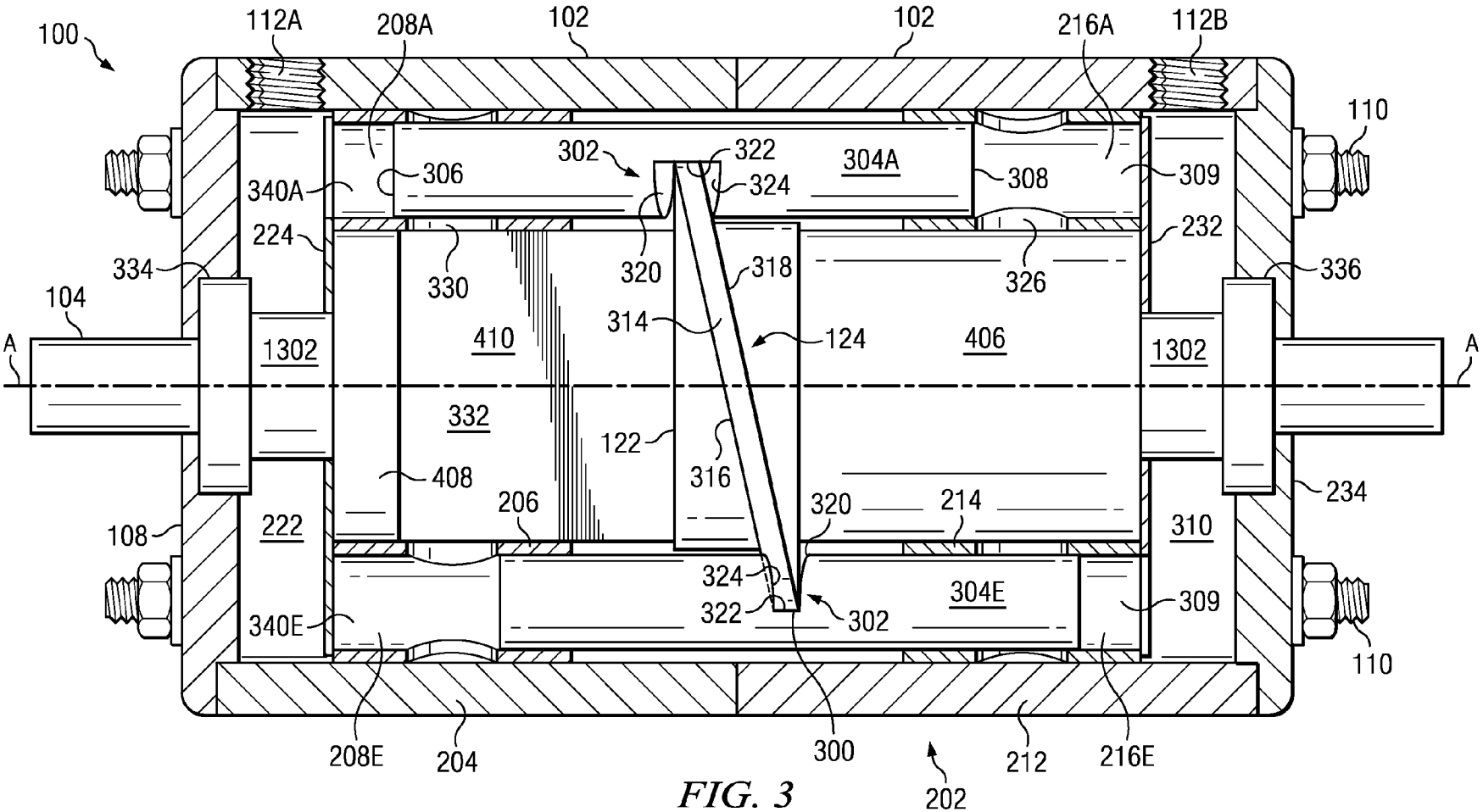
FIG. 3 is an axial sectional view of the pump illustrated in FIG. 1.

Referring to FIGS. 2 and 3, internal components of a preferred pump include the drive shaft 106, which has three principal axial sections. Disposed along the centerline of the pump is a cam fence section 122 on which is formed a circumaxial cam fence 124. An outer margin 300 of the cam fence 124, which is disposed at a constant radius from axis A, engages respective cutouts 302 of each of a plurality of elongate pistons 304, numbering eight in all in the illustrated embodiment. The pistons 304 are cylindrical (in the mathematical definition of that term; the base of the piston and the cylinders in which they are received can be a circle, an ellipse or a polygon). For ease of machining it is preferred that the pistons 304 be circularly cylindrical in shape. Each piston 304 has an axis which is parallel to axis A and is radially displaced therefrom. Preferably the pistons 304 are symmetrically arranged around axis A at equal angular spacing from each other for balance. Also, in this embodiment the pistons 304 are provided in pairs, with an angular separation of the pistons in each pair being 180 degrees relative to the axis A. In the illustrated embodiment, there are four such pairs of pistons 304, although there could be as few as two and more than four. In alternative embodiments that pistons 304 could be unpaired and odd in number, such as three, five, seven or more.

A respective cutout 302 is formed somewhere along the length of each piston 304 and preferably is midway between the opposed piston ends 306 and 308. Each cutout 302 receives the outer margin 300 of the cam fence 124 and, as will be described in more detail below, preferably has sidewalls which exactly match the greatest angle made by any sector of the cam fence 124.

In the illustrated, double-ended embodiment, an end 306 of each piston 304 is received within a respective cylinder 208 of a first cylinder block assembly 200, and a second end 308 is received within a respective cylinder 216 of a second cylinder block assembly 202. Cylinders 208, 216 for any one piston are coaxial with each other. In the illustrated embodiment, the cylinder block assembly 200 is formed by an external circumaxial casing 204 and a cylinder block insert 206, disposed interiorly of the casing 204, in which are formed a plurality of cylinders 216 (here, eight) and a central passage 210 for the drive shaft 106. The second cylinder block assembly 202 similarly is formed by an external circumaxial casing 212 and a cylinder block insert 214 disposed interiorly of the casing 212, in which are formed a plurality of cylinders 216 (here, eight) and a central passage 217 for the drive shaft 106. While the cylinder block assemblies 200, 202 could be formed out of integral, single pieces, it is preferred to separately fabricate the cylinder block inserts 206, 214 and casings 204, 212 for ease in machining. Each of the piston cylinders 208, 216 is arranged in parallel to the axis A and to be radially spaced therefrom. To ensure a coaxial relationship of associated cylinders 208, 216, the inserts 206, 214 can be drilled as an undivided unit to create the cylinders 208, 216, and the inserts 206, 214 then sawn in half.

In FIG. 2, there can be seen an outer axial end wall 220 of casing 204 which extends axially outwardly (here, to the left) of the cylinder block insert 206. The end wall 220 helps define a fluid output chamber 222 to which the left fluid output port 112A communicates through wall 220. Within the end wall 220 there is disposed a left rotary valve 224 that is affixed to and spins with the drive shaft 106. As will be explained in more detail below, the rotary valve 224 serially opens and closes successive ones of the outer axial ends or end ports of the cylinders 208 and is positioned axially inwardly within output chamber 222 (see FIG. 3) so that its axially inward surface is adjacent the cylinder ends. An end cap 108 is fitted onto the axial outer end of the casing 204 to complete the enclosure of the left output chamber 222. Screw holes 228 may be tapped into end cap 108 to provide a means for pulling off the end cap 108 from the casing 200. The casing 204 and the casing 212 together form casing 102 as is depicted in FIG. 1, are butted together and are axially bolted together by the through-bolts 110 (FIGS. 1 and 3).

An axially inward end of the right cylinder block 202 is visible in FIG. 2. An axially inwardly extending circumaxial side wall 230 of casing 212 fits over one-half of the central section 122 of the drive shaft 106. Cylinder block casing 204 similarly has a side wall portion that extends (here, rightward) over the other half of the central section 122 of the drive shaft 106, and cylinder block casing 212 has a similar axially outwardly extending, circumaxial sidewall that extends beyond its respective cylinder block insert to help define a right output chamber 310 (see FIG. 3). A right rotary valve 232 is fitted within this end chamber to selectively open and close end ports 309 of the cylinders 216. A right end cap 234 is fitted onto this end wall to complete the enclosure of the right output chamber 310 and the end cap 234 may have threaded pulling screw holes 312 to assist in removing cap 234 from the casing 212 (FIG. 2).

Further detail of the assembled pump 100 can be seen in FIG. 3. The drive shaft has a central or cam section 122 (best seen in FIGS. 4, 7 and 8) on which is formed the cam fence 124. The cam fence 124 here takes the form of a radially extending fin that projects beyond the generally cylindrical surface of section 122. The cam fence is continuous or endless and in this embodiment has four sectors. A sloping or angled sector 314 appears in this FIGURE. The cam fence has a left wall 316 and a right wall 318 which is axially spaced from the left wall 316 by a constant spacing. The radial outer margin 300 of the cam fence 124 conforms to a cylindrical surface around axis A, regardless of the sector in which it appears.

Figure 11A:
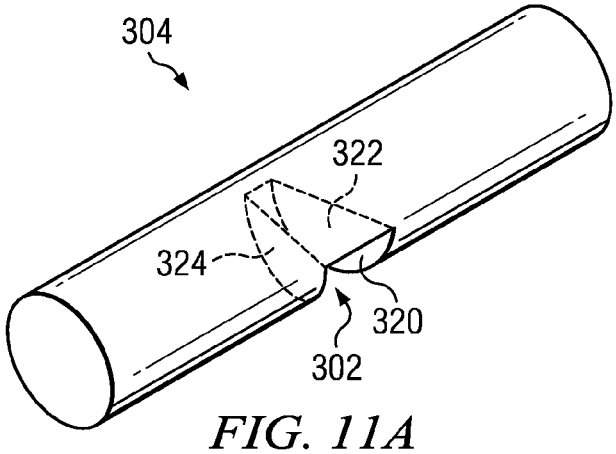
FIGS. 11A-11C are isometric, radially inward, and side views of one of the pistons used in the pump shown in FIGS. 1-3.
Figure 11B:
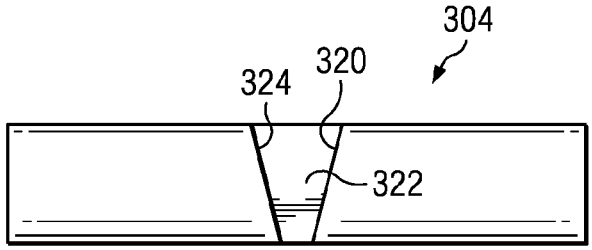
Figure 11C:
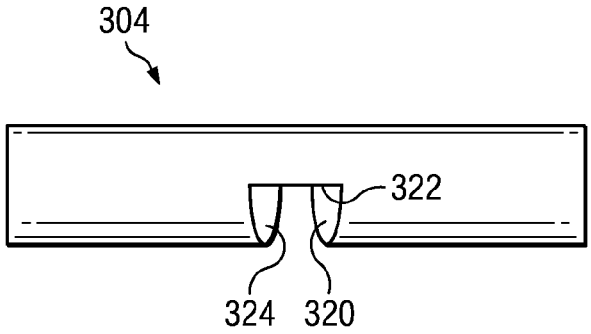

As seen in more detail in FIGS. 11A-11C, each cutout 302 is formed by a first sidewall 320 that extends from an outer side cylindrical surface of the piston 304 to a bottom surface 322 that is held at a greater radial distance from axis A than is the closest side of the piston 304 into which the cutout 302 is formed. The cutout 302 faces radially inwardly toward axis A. The bottom surface 322 may be concavely cylindrical, conforming to a cylinder around axis A, or as illustrated may be flat for ease in machining. An axial length of the bottom surface 322 is a little longer than the axial thickness of the cam fence 124 between sidewalls 316 and 318. A right side wall 324 of the cutout 302 extends from the bottom cutout surface 322 back to the general cylindrical surface of the piston 304. Like surface 320, the surface 324 is angled rather than orthogonal to axis A.

Piston cutout side walls 320 and 324 are angled with respect to the axis A but are parallel to any radius drawn to piston 304 from axis A. The angle of side wall 320 taken with respect to a plane which is orthogonal to axis A is the negative or opposite of the angle of side wall 324. As seen in FIG. 11B, one end of the cutout 302 is only slightly larger than the thickness of cam fence 124, while the other end is substantially greater. Preferably, the angles of cutout sidewalls 320 and 324 are chosen to match the angle of cam fence sector 314 or its negative. If, in alternative embodiments, any portion of cam fence 124 is at an even greater angle to the axis than is sectors 314 or 606 (FIG. 6), then sidewalls 320 and 324 would be machined to conform to this greater angle.

Figure 5:
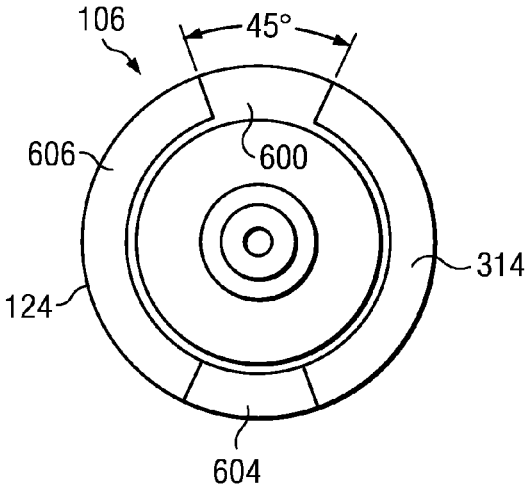
FIG. 5 is an end view of the shaft shown in FIG. 4.

The section taken in FIG. 3 passes through a first piston 304A and, four angular positions removed from it, a fifth piston 304E that is 180 degrees removed from piston 304A. In the case of piston 304A, the converging angles of the cutout side walls 324 and 320 can be seen. In the illustrated embodiment the sector 314 extends through about 135 degrees as measured around axis A (see FIG. 5) while another sector 606, at an angle which is the exact negative of the angle of cam fence sector 314, also extends through about 135 degrees. When cutout 302 is riding on cam fence sector 314, the angle of cutout surface 320 will preferably exactly match it. When cutout 302 is riding on cam fence sector 606 (not shown in FIG. 3) its angle will preferably exactly match the angle of cutout surface 324.

In the moment in time captured in FIG. 3, piston 304A is waiting but will soon be urged rightward, and piston 304E is waiting but will soon be urged leftward. It is preferred that at least during the high-pressure output stroke of pistons 304, as much of the surface area of the cam fence side wall 316 or 318 be engaged with the piston cutout sidewall surfaces 320 or 324 to maximally distribute the pressure at this interface.

The right piston head 308 of piston 304A has been withdrawn leftward to open up a side port 326 of the cylinder 216A. This has drawn in fluid from a preferably semicylindrical inlet reservoir volume 328 (see FIGS. 4, 7 and 8) into cylinder 216A. The side port is about to be closed by drive shaft cylindrical side port closing surface 406. Opposed left piston head 306 of piston 304A has finished its compression or expulsion stroke and is blocking the side port 330 of left cylinder 208A. End port 340A of cylinder 208A is still open, permitting communication between the interior of cylinder 208A and the left exit reservoir or output chamber 222. There is no communication with the inlet reservoir or more particularly with inlet reservoir volume 332, and the high pressure output chamber 222 therefore is effectively closed off from the low-pressure inlet reservoir. As piston 304A is moved rightward by cam fence 124, the right end 308 of piston 304A will be expelling fluid out of the cylinder 216A, while the left end 306 of piston 304A will be drawing fluid into cylinder 208A. Rotary valve 224 will close end port 340A before this happens to isolate high-pressure chamber 222 from the relatively low-pressure inlet reservoir.

The drive shaft 104 rotates on bearings 334, 336 which can be positioned in respective recesses in the end caps 108, 234.

Figure 4:
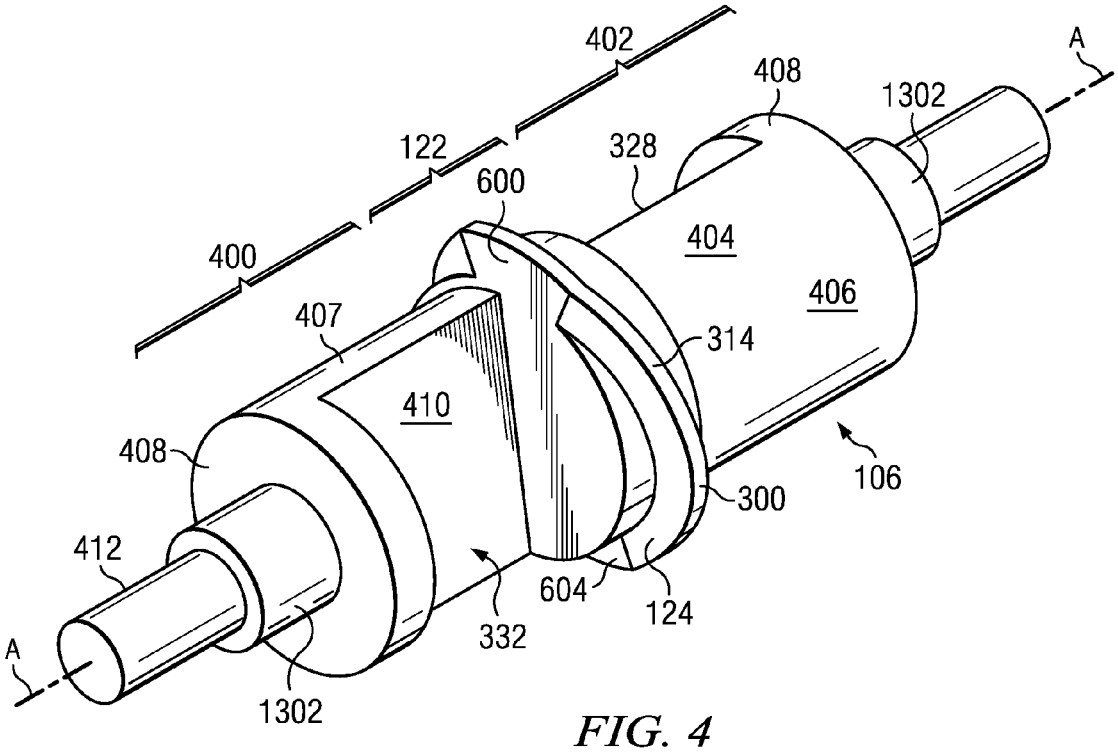
FIG. 4 is an isometric view of a drive shaft for use in the embodiment shown in FIGS. 1-3.
Figure 7:
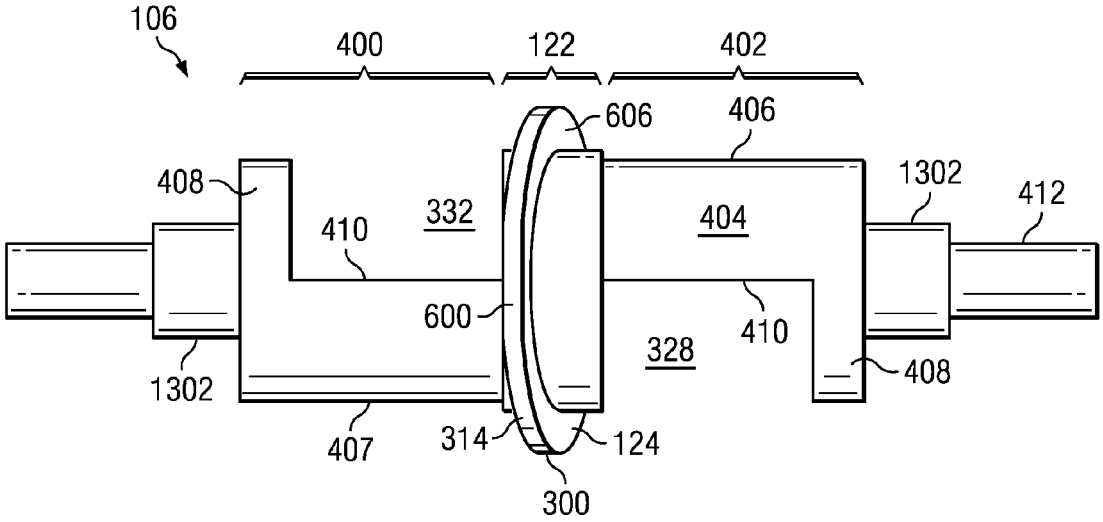
FIG. 7 is a side view of the drive shaft shown in FIGS. 4-5.
Figure 8:
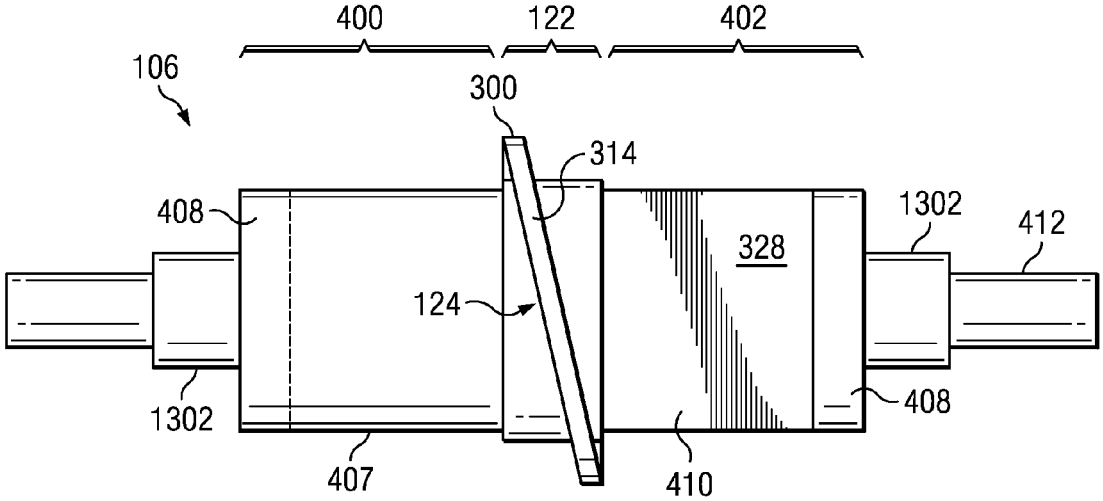
FIG. 8 is a top view of the drive shaft, taken from an axial angle ninety degrees from the view shown in FIG. 7.

In FIGS. 4, 7 and 8, it is seen that the central section 122 of the drive shaft 106 is flanked by a left inlet section 400 and a right inlet section 402. In the illustrated embodiment the sections 400, 402 are mirror images of each other and are 180 degrees out of phase from each other. Each section 400, 402 includes an inlet reservoir volume 328 or 332, which are in continuous communication with each other and with the inlet ports 114 made through the external casing 102. Through the inlet reservoir 328's axial length, a solid portion 404 occupies a predetermined segment of the cylinder, such as half of it. The associated inlet reservoir volume occupies the rest of the cylindrical space partially occupied by solid portion 404. The solid portion 404 has a solid outside cylindrical surface 406 which, when it has been rotated to the appropriate position, will block the side port 326 of each of three or four cylinders 216 associated with respective pistons 304. Hence, the right inlet reservoir 328 will be in communication with some of the cylinders 216, and surface 406 will be blocking the rest. The left inlet section 400 has a similar blocking surface 407 which conforms to a segment of a cylindrical surface, such as a semicylinder. Each of the flanking sections 400, 402 has an axially outward disklike wall 408 which separates the reservoir volumes 332, 328 (and the inlet reservoir considered as a whole) from the respective adjacent outlet chambers 222, 310. Axially outward from the walls 408 are shoulders 1302 on which rotary valves 224, 232 are installed.

For ease of fabrication the radial interior boundary 410 of the reservoir volumes 328, 332 is preferably a flat plane aligned with and containing axis A. However, as long as the semicylindrical side port blocking or closing surfaces 406, 407 are unchanged, the inlet reservoir volume radial inward surface 410 can take another shape. In one alternative embodiment the surface 410 can include a convex semicylindrical component of the same radius as is shaft end 412, for the purpose of resisting torque. In another alternative embodiment, the surface 410 can be hogged out or made concave in order to expand the volume of the inlet reservoirs 328, 332 and to save weight.

Figure 6:
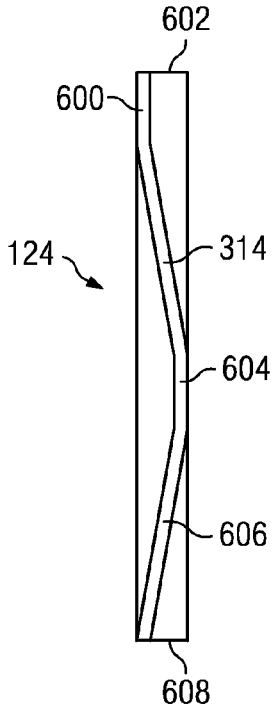
FIG. 6 is a cylindrical-to-planar projection of a cam fence of the drive shaft shown in FIGS. 4-5.

In FIG. 6, the cam fence 124 has been laid out flat, in cylindrical-to-planar projection, through all 360 degrees around axis A. In this embodiment a flat sector 600 extends for about 45 degrees from an end 602 to the beginning of sloped sector 314, which extends through about 135 degrees. The further end of sloped sector 314 is joined to the beginning of a second flat sector 604, which extends through about another 45 degrees. The loci or axial positions of sectors 600 and 604 do not change as a function of angle and they are axially displaced from each other by a distance which is the same as the piston stroke. A second sloped sector 606, taking a slope which is the opposite or negative of the slope taken by sector 314, extends to end 608 which wraps to end 602. Those pistons 304 having cutouts 302 which currently are riding on flat sectors 600, 604 won't move. The pistons 304 having cutouts 302 that are currently riding on the sloped sectors 314, 606 will be moving in one axial direction or the other.

Figure 9:
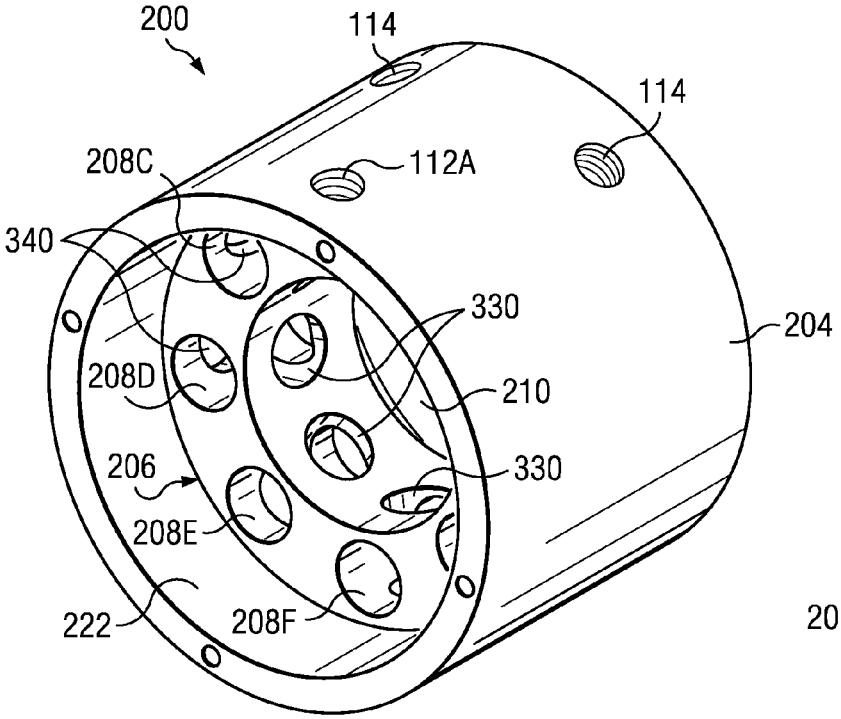
FIG. 9 is an isometric view of a cylinder block assembly for use in the embodiment shown in FIGS. 1-3.
Figure 10B:
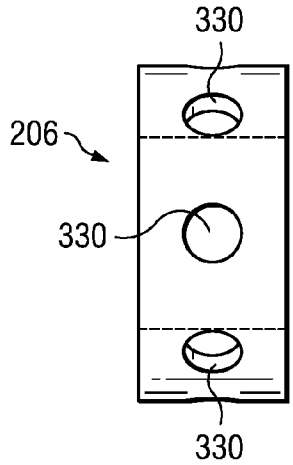
FIG. 10B is a side view of the cylinder block insert shown in FIG. 10A.
Figure 10A:
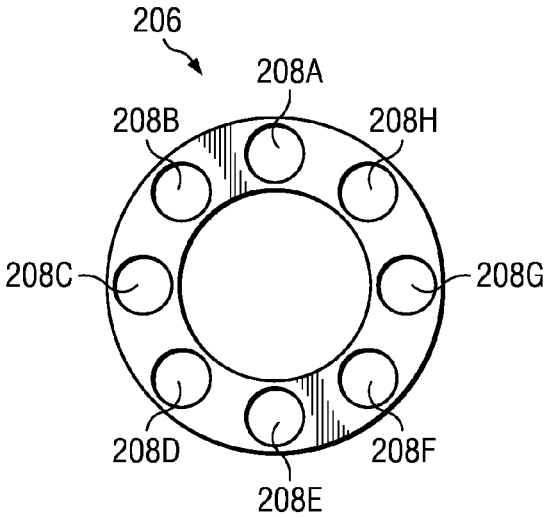
FIG. 10A is an end view of a cylinder block insert used in the cylinder block assembly shown in FIG. 9.
Figure 10C:
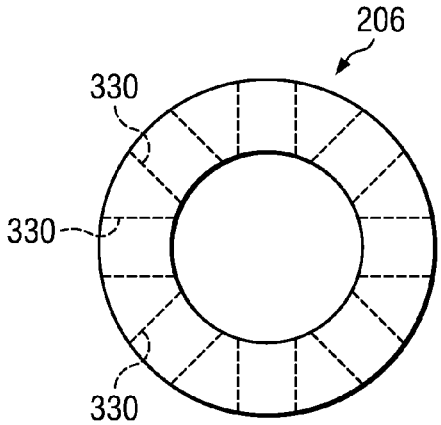
FIG. 10C is an end view of the cylinder block insert shown in FIGS. 10A-10B, axial bores having been omitted and radial bores shown in hidden line.

FIG. 9 is an isometric view of a cylinder block assembly, taking cylinder block assembly 200 as an example. A cylinder block insert 206 has been press-fit into the casing 204 by a predetermined distance. End ports 340 of cylinders 208A-208H open onto an axially outward exit chamber 222. Two inlet ports 114 and an outlet port 112A can be seen, all drilled and (in the illustrated embodiment) tapped through the casing wall. Each of the cylinders 208A-208H is angularly aligned with a bore that produces a respective cylinder side port 330. Cylinders 208A-208H and side ports 330 can also be seen in FIGS. 10A-10C.

FIGS. 11A-11C show a preferred form of the pistons 304. The cutout 302 in each piston has a flat bottom wall 322 that in use faces the drive shaft axis and is parallel to it. Each of side walls 320, 324 is angled in one direction only: if a radius is drawn at right angles from axis A to surface 322, each of walls 320, 324 conforms to a respective plane which is parallel to this radius and which will not intersect this radius. Each of the walls 320, 324 is, however, disposed at an angle to the drive shaft axis A itself. The surfaces 320, 324 preferably match the angle of the surfaces 316, 318 of the sloped cam fence sectors 314, 606. In this way, maximum contact surface area between cam fence 124 and piston 304 will be achieved during that portion of the piston stroke in which fluid is being expelled out of a respective cylinder 208 or 216.

Figure 12:
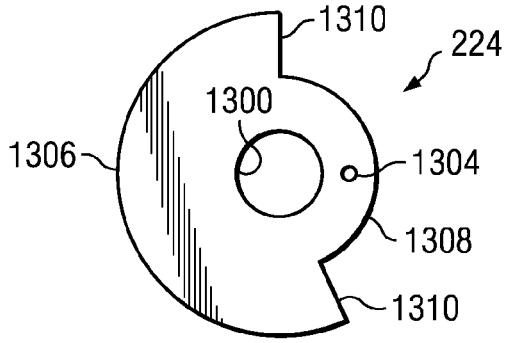
FIG. 12 is an end view of a rotary valve used in the embodiment shown in FIGS. 1-3.

FIG. 12 is an end-on detail of one of the rotary valves, taking valve 224 as an example. Rotary valve 224 is preferably fabricated from a flat sheet of a material such as aluminum or steel. The valve has an inner bore 1300 that fits onto shoulder 1302 of drive shaft 106 (FIGS. 7 and 8). A hole 1304 takes a bolt which is used to affix the rotary valve in place on drive shaft 106, so that the rotary valve 224 and drive shaft 106 rotate as a unit. Most of the radial margin of the valve 224 is formed by an arc 1306 which subtends an angle substantially greater than 180 degrees, and in the illustrated embodiment can extend to cover 180 degrees plus at least the arc taken up by one of the cylinders 208 as viewed from axis A. Arc 1306 is disposed at a radius from axis A which is a little less than the radius of the limit of output chamber 222 (FIG. 3), so as to completely cover the end ports 340 of each of four cylinders 208. In the illustrated embodiment arc 1306 is about 205 degrees. The rest of the lateral periphery of the rotary valve 224 includes an arc 1308 at a radius that is less than that at which any portion of the cylinders 208 is positioned. Arc 1308 will leave completely uncovered the end ports 340 of three adjacent cylinders 208. Straight radial segments 1310 join arcs 1306 and 1308. The transitions between arcs 1306 and 1308 can be other than shown.

Figure 13A:
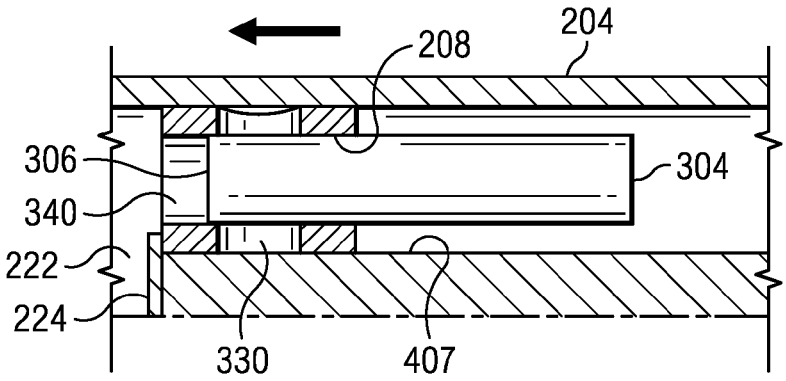
FIGS. 13A-13F are schematic views of one piston and one cylinder, showing successive stages of operation of the invention.

FIGS. 13A-13F are successive views of the operation of one end of one of the pistons 304 inside a respective cylinder 208. In FIG. 13A, end port 340 is open, communicating the interior of cylinder 208 to the high-pressure exit chamber 222. As depicted, the piston 304 is at the end of its pressure stroke and the piston head 306 has advanced farthest leftward. The side port 330 has been closed by drive shaft semicylindrical closing surface 407.

Figure 13B:
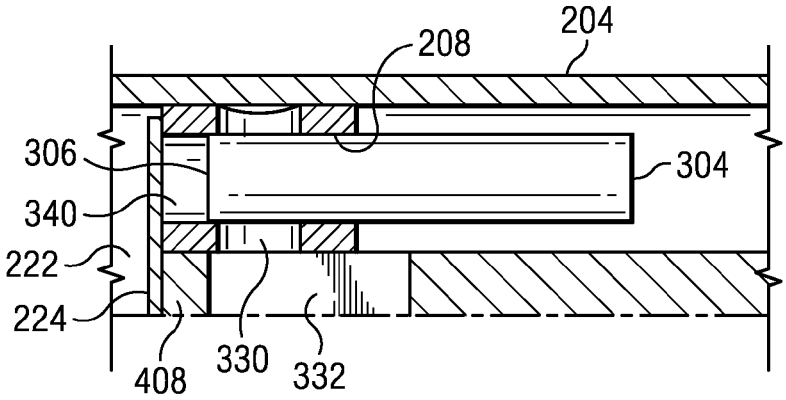

In FIG. 13B, the rotary valve 224 has closed the end port 340, such that the end chamber 222 is no longer in communication with the interior of cylinder 208. Piston 304 is not moving, and is riding on the leftmost one of the nonsloped sectors of the cam fence 124. As drive shaft 106 turns, the sealing or closing surface 407 is replaced by the space making up inlet reservoir volume 332, communicating to the interior of cylinder 208 by now-open side port 330.

Figure 13C:
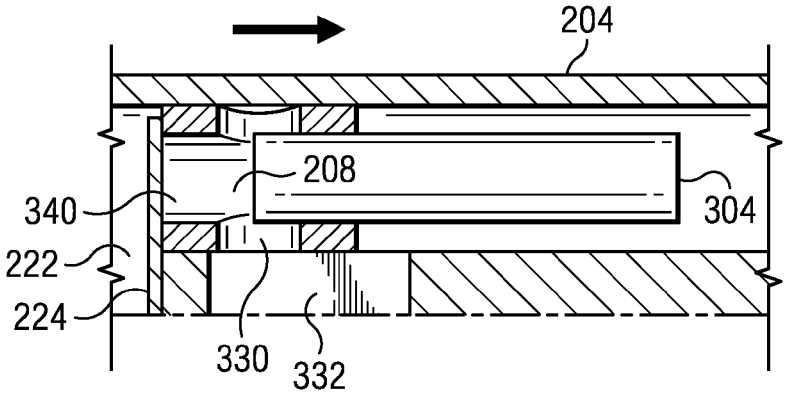

In FIG. 13C, end port 340 continues to be closed. Piston 304 is withdrawing rightward in cylinder 208. This causes fluid to be drawn from inlet reservoir 332 through side port 330 into the interior of cylinder 208.

Figure 13D:
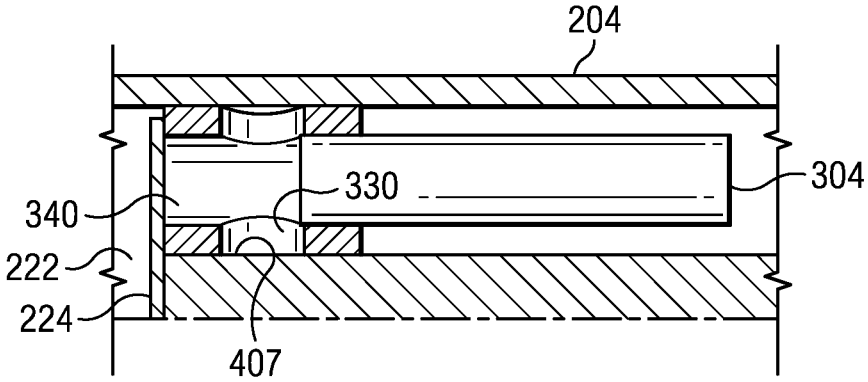

Turning next to FIG. 13D, the piston 304 has completed its intake stroke and is beginning to pause, riding on flat sector 604 of cam fence 124 (see FIG. 6). Rotary valve 224 continues to keep end port 340 closed. As drive shaft 106 rotates, the inlet reservoir is replaced with the closing or sealing surface 407, shutting the side port 330.

Figure 13E:
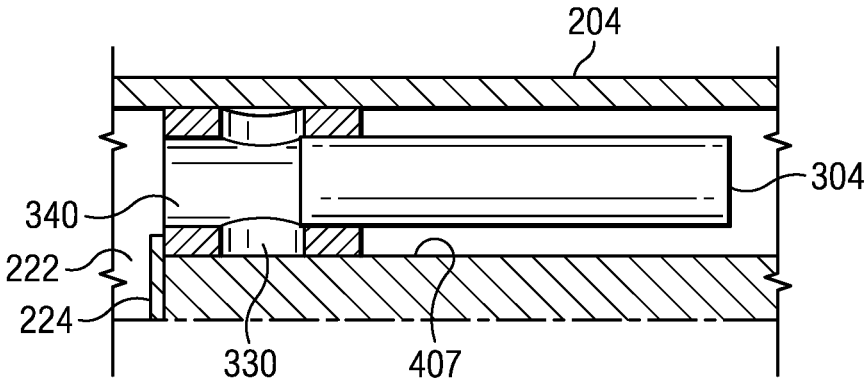

In FIG. 13E, the piston 304 continues to pause. The side port 330 continues to be completely closed by the interposition of surface 407. Rotary valve 224 opens the end port 340.

Figure 13F:
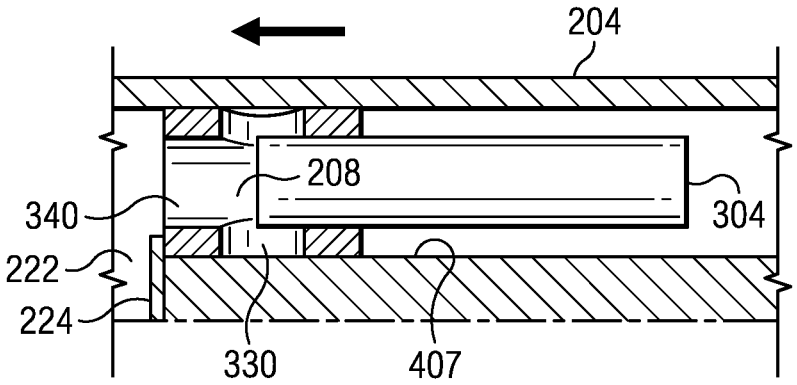

Finally, in FIG. 13F, the piston 304 begins its compression stroke, expelling fluid in the cylinder 208 through end port 340 into the exit or output chamber 222. Surface 407 continues to block side port 330 while this is happening. The cycle then repeats back to FIG. 13A.

At any moment in time, some of the pistons 304 will be moving in a first axial direction, some of the pistons 304 will be moving in a second, opposite axial direction, and some of the pistons 304 will be pausing. More particularly, and with respect to the sixteen-piston-end embodiment illustrated (eight double ended pistons), six piston ends will be producing pressure, six piston ends will be withdrawing, and four piston ends will be pausing.

Pumps according to the invention may be fabricated of any of a variety of materials, depending on their intended application, from hard acrylic plastic to aluminum and hardened steel. Various parameters of the pump may be easily altered: size and number of pistons, length of stroke, desired output fluid pressure. Because of the reduction in the number of parts as compared with conventional structures, it is expected that pumps according to the invention will have a 50% to 70% reduction in manufacturing cost relative to conventional pumps of comparable volume/pressure combination.

In summary, a hydraulic pump has been provided in which the torque of a central drive shaft is communicated to each of a plurality of pistons via a cam fence which radially projects from the drive shaft to be received by cutouts in the pistons. The pistons are arranged to be displaced in parallel to the drive shaft axis. In the preferred double-ended embodiment, one end of the piston is drawing fluid into a cylinder from an inlet reservoir, while the other end is expelling fluid into an end chamber.

While illustrated embodiments of the present invention have been described and illustrated in the appended drawings, the present invention is not limited thereto but only by the scope and spirit of the appended claims.

I claim:

1. A hydraulic pump, comprising:

a drive shaft rotating on an axis;

a circumaxial cam fence formed on the drive shaft and extending radially outwardly therefrom, an outer margin of the fence located at a predetermined radius from the axis, a locus of the outer margin of the fence varying in a direction parallel to the axis and as a function of the angular position of the margin relative to the axis;

at least one elongate piston disposed in parallel to and spaced from the axis, the piston having a side wall, a cutout formed in the side wall of the piston and engaging the outer margin of the cam fence, axial displacement of the cam fence as the drive shaft rotates causing axial displacement of the piston;

at least one cylinder disposed in parallel to and spaced from the axis, an interior of the cylinder slidably receiving an end of the piston;

a side port formed in the cylinder for interruptedly communicating the interior of the cylinder to an inlet reservoir formed radially interiorly of the cylinder, an end port formed in the cylinder to be opposed to the piston end, the end port interruptedly communicating the interior of the cylinder to an output chamber formed around the drive shaft; and a rotary valve operable to periodically open and close the end port of the cylinder, the rotary valve rotating as a unit with the drive shaft and disposed in the output chamber adjacent the cylinder end port.

2. The hydraulic pump of claim 1, wherein said at least one piston is one of a plurality of pistons angularly spaced from each other around the axis, ends of the pistons received in respective cylinders each having an end port communicating with the output chamber, the rotary valve opening at least one of the end ports to permit expulsion of fluid from the interior of the respective cylinder while keeping closed others of the end ports.

3. The hydraulic pump of claim 2, wherein the rotary valve has a flat surface facing the end ports, a radially outward margin of the rotary valve comprising a first arc at a first predetermined radius which is greater than the radial displacement of any part of the cylinders from the axis and a second arc at a second predetermined radius which is less than the radial displacement of any part of the cylinders from the axis, the positioning of the first arc adjacent an end port causing the last said end port to close, positioning of the second arc adjacent an end port causing the last said end port to remain open.

4. A hydraulic pump, comprising:

a drive shaft rotating on an axis;

a circumaxial cam fence formed on the drive shaft and extending radially outwardly therefrom, an outer margin of the fence located at a predetermined radius from the axis, a locus of the outer margin of the fence varying in a direction parallel to the axis and as a function of the angular position of the margin relative to the axis;

at least one elongate piston disposed in parallel to and spaced from the axis, the piston having a side wall, a cutout formed in the side wall of the piston and engaging the outer margin of the cam fence, axial displacement of the cam fence as the drive shaft rotates causing axial displacement of the piston;

at least one cylinder disposed in parallel to and spaced from the axis, an interior of the cylinder slidably receiving an end of the piston; and a side port formed in the cylinder for interruptedly communicating the interior of the cylinder to an inlet reservoir formed radially interiorly of the cylinder, an end port formed in the cylinder to be opposed to the piston end, the end port interruptedly communicating the interior of the cylinder to an output chamber formed around the drive shaft;

wherein rotation of the drive shaft causes, in a first stage of operation, the refraction of the piston end in a first direction parallel to the axis, the retraction of the piston drawing fluid into the cylinder interior from the inlet reservoir through the cylinder side port;

further rotation of the drive shaft, in a second stage of operation subsequent to the first stage, causing the closing of the cylinder side port and the opening of the cylinder end port; and still further rotation of the drive shaft, in a third stage of operation subsequent to the second stage, advancing the piston end in a second direction opposite the first direction, thereby pumping fluid in the cylinder through the cylinder end port and into the output chamber.

5. The hydraulic pump of claim 4, wherein the pump has eight pistons angularly equally spaced from each other around the drive shaft.

6. A hydraulic pump, comprising:

a drive shaft rotating on an axis;

a circumaxial cam fence formed on the drive shaft and extending radially outwardly therefrom, an outer margin of the fence located at a predetermined radius from the axis, a locus of the outer margin of the fence varying in a direction parallel to the axis and as a function of the angular position of the margin relative to the axis;

at least one elongate piston disposed in parallel to and spaced from the axis, the piston having a side wall, a cutout formed in the side wall of the piston and engaging the outer margin of the cam fence, axial displacement of the cam fence as the drive shaft rotates causing axial displacement of the piston;

at least one cylinder disposed in parallel to and spaced from the axis, an interior of the cylinder slidably receiving an end of the piston; and a side port formed in the cylinder for interruptedly communicating the interior of the cylinder to an inlet reservoir formed radially interiorly of the cylinder, an end port formed in the cylinder to be opposed to the piston end, the end port interruptedly communicating the interior of the cylinder to an output chamber formed around the drive shaft;

wherein the cam fence includes a first angular sector whose locus does not vary in an axial direction as a function of its angle with the axis, and a second angular sector joined to the first angular sector whose locus does vary in an axial direction as a function of its angle with the axis.

7. The hydraulic pump of claim 6, wherein the cam fence has first and third angular sectors each of whose locus does not vary in an axial direction as a function of its angle with the axis, the axial position of the first angular sector being displaced from an axial position of the third angular sector, the cam fence having second and fourth angular sectors which join together ends of the first and third angular sectors.

8. A hydraulic pump, comprising:

a drive shaft rotating on an axis;

a circumaxial cam fence formed on the drive shaft and extending radially outwardly therefrom, an outer margin of the fence located at a predetermined radius from the axis, a locus of the outer margin of the fence varying in a direction parallel to the axis and as a function of the angular position of the margin relative to the axis;

at least one elongate piston disposed in parallel to and spaced from the axis, the piston having opposed first and second ends and a side wall extending between the first and second ends, a cutout formed in the side wall of the piston and engaging the outer margin of the cam fence, axial displacement of the cam fence as the drive shaft rotates causing axial displacement of the piston;

for said at least one elongate piston, first and second cylinders disposed in parallel to and spaced from the axis, an interior of each of the cylinders slidably receiving a respective end of the piston;

first and second output chambers formed around the drive shaft to be axially spaced from each other, a first end port of the first cylinder in periodic communication with the first output chamber, a second end port of the second cylinder in periodic communication with the second output chamber, the first cylinder having a first side port through a side wall of the first cylinder, the second cylinder having a second side port through a side wall of the second cylinder;

a first inlet section of the drive shaft displaced axially from the cam fence in a first direction, the first inlet section including a first side port closing surface formed as a portion of a cylindrical surface, the drive shaft rotatable to effect the closing of the first side port by the first side port closing surface, the first inlet section further including a first inlet reservoir volume in communication with the first cylinder when the first side port is open; and a second inlet section of the drive shaft displaced axially from the cam fence in a second direction opposite the first direction, the second inlet section including a second side port closing surface formed as a portion of a cylindrical surface, the drive shaft rotatable to effect the closing of the second side port by the second side port closing surface, the second inlet section further including a second inlet reservoir volume in communication with the second cylinder when the second side port is open;

wherein said at least one piston is one of a plurality of elongate pistons arranged in parallel to each other and to the axis and radially displaced from the axis, each piston having a side wall with a cutout which slidably engages the cam fence of the drive shaft; and wherein of the plurality of pistons, and at any particular moment in time, one or more of the pistons is not being displaced in either axial direction, one or more of the pistons is being displaced in the first axial direction, and one or more of the pistons is being displaced in the second axial direction.

* * * * *